United States Patent [19]

Sarraf et al.

[11] Patent Number: 5,002,122

[45] Date of Patent: Mar. 26, 1991

[54] TUNNEL ARTERY WICK FOR HIGH POWER DENSITY SURFACES

[75] Inventors: David B. Sarraf, Elizabethtown; Robert M. Shaubach, Lititz; George Y. Eastman, Lancaster, all of Pa.

[73] Assignee: Thermacore, Inc., Lancaster, Pa.

[21] Appl. No.: 653,886

[22] Filed: Sep. 25, 1984

[51] Int. Cl.[5] ..... F28D 15/00

[52] U.S. Cl. ..... 165/104.26; 165/104.19

[58] Field of Search ..... 165/104.26, 46, 905, 165/10, 104.19; 501/11; 264/56, 59, 63, 332

[56] References Cited

U.S. PATENT DOCUMENTS

| | | | |
|---|---|---|---|
| 3,161,478 | 12/1964 | Chessin . | |
| 3,212,573 | 10/1965 | Valyi . | |
| 3,229,759 | 1/1966 | Grover . | |
| 3,413,239 | 11/1968 | Olstowski . | |
| 3,942,880 | 3/1976 | Zeiders, Jr. | 350/310 |
| 4,082,863 | 4/1978 | Dancy . | |
| 4,087,893 | 5/1978 | Sata et al. | 29/157.3 R |
| 4,196,504 | 4/1980 | Eastman | 29/157.3 R |
| 4,222,434 | 9/1980 | Clyde . | |
| 4,372,377 | 2/1983 | Morris . | |
| 4,378,626 | 4/1983 | Eitel . | |
| 4,393,565 | 7/1983 | Willson, II et al. . | |
| 4,565,243 | 1/1986 | Ernst | 165/104.26 |

*Primary Examiner*—Donald P. Walsh

*Attorney, Agent, or Firm*—Martin Fruitman

[57] ABSTRACT

A heat transfer surface structure for cooling high power density surfaces and the method of constructing it. The surface includes a sintered capillary layer with a complex configuration of tunnels within it constructed adjacent to the heated surface which is subject to very high power densities. The tunnel arteries serve to supply evaporable liquid and remove vapor to provide the cooling. A unique method of constructing the tunneled sintered layer is also described.

26 Claims, 2 Drawing Sheets

TUNNEL ARTERY WICK FOR HIGH POWER DENSITY SURFACES

The United States Government has rights to this invention pursuant to Contract No. F33615-82-C-5127 between the United States Air Force and Thermacore, Inc.

SUMMARY OF THE INVENTION

This invention deals generally with heat pipes and more specifically with a capillary layer for use as a heat transfer surface of a heat pipe subjected to high power density heat input, and also with the method of making the capillary layer with integral liquid tunnels.

The technology of heat pipes is well established. A heat pipe is a device for transferring heat by means of the evaporation and condensing cycle of a liquid enclosed in a casing from which non-condensible gases have been removed. Typically, the heat pipe has a cylindrical configuration, and the liquid is evaporated at one end of the cylinder and condensed at the other. The liquid is then returned to the heated evaporator end by the capillary action of a wick structure lining the inside surface of the cylinder.

A significant limitation on the amount of heat a heat pipe can transfer in a given time, that is, its power capability, is the amount of power that can be accommodated at the heat transfer surface where the capillary action is moving liquid to or from the surface while heat transfer is taking place. One method of overcoming this limitation is the use of internal tunnel arteries within a sintered wick structure with high thermal conductivity. Such a structure is described in U.S. Pat. No. 4,196,504 by George Y. Eastman along with a method of constructing such tunnels. The tunnels described in that patent are, however, of the simplest configuration available in a heat pipe, straight longitudinal tunnels parallel to the cylindrical casing. No tunnels have yet been used in any configuration very different from those shown there, very likely because of the considerable difficulty in constructing them.

The present invention is a heat pipe used for cooling of a surface subject to extreme heat. It thus requires cooling, not of the cylindrical surface of the typical heat pipe, but essentially of what has up to now been considered only the sealing end plate of the cylinder. When such a surface is suitably small in dimension and subjected to only moderate heat input, the capillary action of a continuous sintered layer can conceivably deliver enough liquid to it from tunnels around the inner cylindrical surface. However, as the flat surface dimensions increase, and as the power input increases, capillary action through sintered material, which has a relatively high resistance to flow, can not supply sufficient liquid for cooling.

Moreover, the high power input to the surface requires special construction to accommodate the thermal strain set up in the surface itself, caused by the temperature differential across the surface. The requirement of an undistorted surface means not only that the high power input must be effectively removed from the surface, inside the heat pipe, but also that the surface must be constructed in a configuration which minimizes distortion.

The present invention therefore includes a heat pipe to whose evaporator is attached a planar sintered layer with a group of tunnels formed within the sintered layer. The structure is further complicated by the need for control of thermally induced strain on the heated surface. This control is accomplished by an array of supports protruding through the sintered layer from the backside of the heated surface and abutting against a heavier supporting "strong back" structure. The supports may also be bonded to the supporting "strong back".

The heated end of the heat pipe therefore involves a flat, heated outside surface of the casing with multiple supports protruding into the heat pipe; a porous sintered layer on the backside of the heated surface, in intimate contact with it and with its supports, but including within the sintered layer a network of intersecting tunnel arteries which avoid the protruding supports; and also some means for furnishing liquid and removing vapor from the network of arteries.

The structure is a unique solution to the unique problem of cooling a high power density flat surface, and the method of constructing it requires an extension of the present state of the art.

When the supports are oriented in a regular gridwork, the spaces between them are available for the tunnel arteries, but no prior art method is satisfactory for making the tunnels. Drilling the tunnels, even with the most sophisticated equipment available, causes destructive crumbling of the fragile, brittle, sintered layer; and casting the sintered layer around forms which are later pulled out, as in U.S. Pat. No. 4,196,504, can not produce a planar pattern of intersecting tunnels. The present invention therefore includes the method of constructing the special configuration of the evaporator section of the heat pipe.

The preferred embodiment of the method involves the use of a core in the shape of the entire pattern of the network of arteries. This core is fitted onto the previously machined flat surface with its protruding supports after a thin layer of sintering powder is used to cover the back of the flat surface. The supports themselves fit through generous clearance holes drilled in the wafer-like core. The sintering powder is then poured around the protruding supports and into the holes through which the supports protrude. This entire assembly is formed within a sleeve to support the exterior edges of the sintering powder.

The complete assembly is then heated to the appropriate temperature under an inert gas blanket in an oven for approximately 15 minutes to sinter the porous wick structure, and it is then cooled. The assembly is then removed from the sleeve leaving a solid part consisting of a sintered wick interlocked with a core.

The sintering process of the preferred embodiment, known as "loose sintering", is not the only means for sintering. Another well-known method consisting of hot high pressure sintering of the material might also be used.

This assembly is then reheated to 1000 degrees in an oxidizing atmosphere for a longer time, approximately one hour, long enough to completely burn away the core. After cooling, the assembly remaining is the desired flat casing surface with its backside, the side which will be enclosed within the heat pipe, completely covered with the sintered wick material, but with a network of tunnel arteries interlaced between the supports, and around the periphery of the assembly. The sides of the supports are also covered with a layer of the sintered wick material.

In the preferred embodiment this wick material is also unique. The invention described here has been constructed for cooling a silicon surface constructed to be flat. The most desirable wick material for such an application is powdered silicon itself, but sintering powdered silicon itself requires hot pressing which is difficult with such a complex configuration, and it yields a wick with only marginal structural characteristics. The present invention solves this problem by using a mixture of glass and silicon as the sintering material.

The glass is selected to match the thermal expansion coefficient of silicon and is mixed with the silicon powder in a proportion of between 10 and 20 percent glass by volume. Too little glass results in poor bonding and insufficient strength. Too much glass results in loss of permeability because it blocks the pores of the sintered silicon. The resulting sintered wick is one which has characteristics essentially similar to those of a pure silicon sintered wick, but its structural strength and stability is such that it not only survives subsequent assembly operations, but furnishes troublefree long life within the heat pipe environment. Moreover, it can be produced by the relatively simple oven firing method described above.

Assembly of the heat pipe after construction of the flat surface and tunnel wick assembly follows conventional assembly techniques in which a silicon sleeve and strong back are bonded to the flat surface, a heat pipe casing of appropriate length is attached to the end fitting, the non-condensible gases are evacuated from the casing, working fluid is put in and the casing sealed off.

The end fitting which contacts the sintered wick does, however, include two types of large passages which pierce the strong back and wick. One type passage connects with the tunnels in the sintered wick, which act as vapor passages; and the other type passage is attached to conventional screen arteries that reach to the condenser end of the heat pipe and carry liquid to the liquid manifold in the sintered wick. The vapor passages connect the tunnels to the vapor space within the heat pipe to permit vapor to move out of the sintered wick and toward the condenser region of the heat pipe.

The unique construction of the evaporator region of the heat pipe of the present invention permits a flat surface to absorb higher power densities than before, and to maintain its critical flatness while doing so.

DETAILED DESCRIPTION OF THE INVENTION

Figure 1:
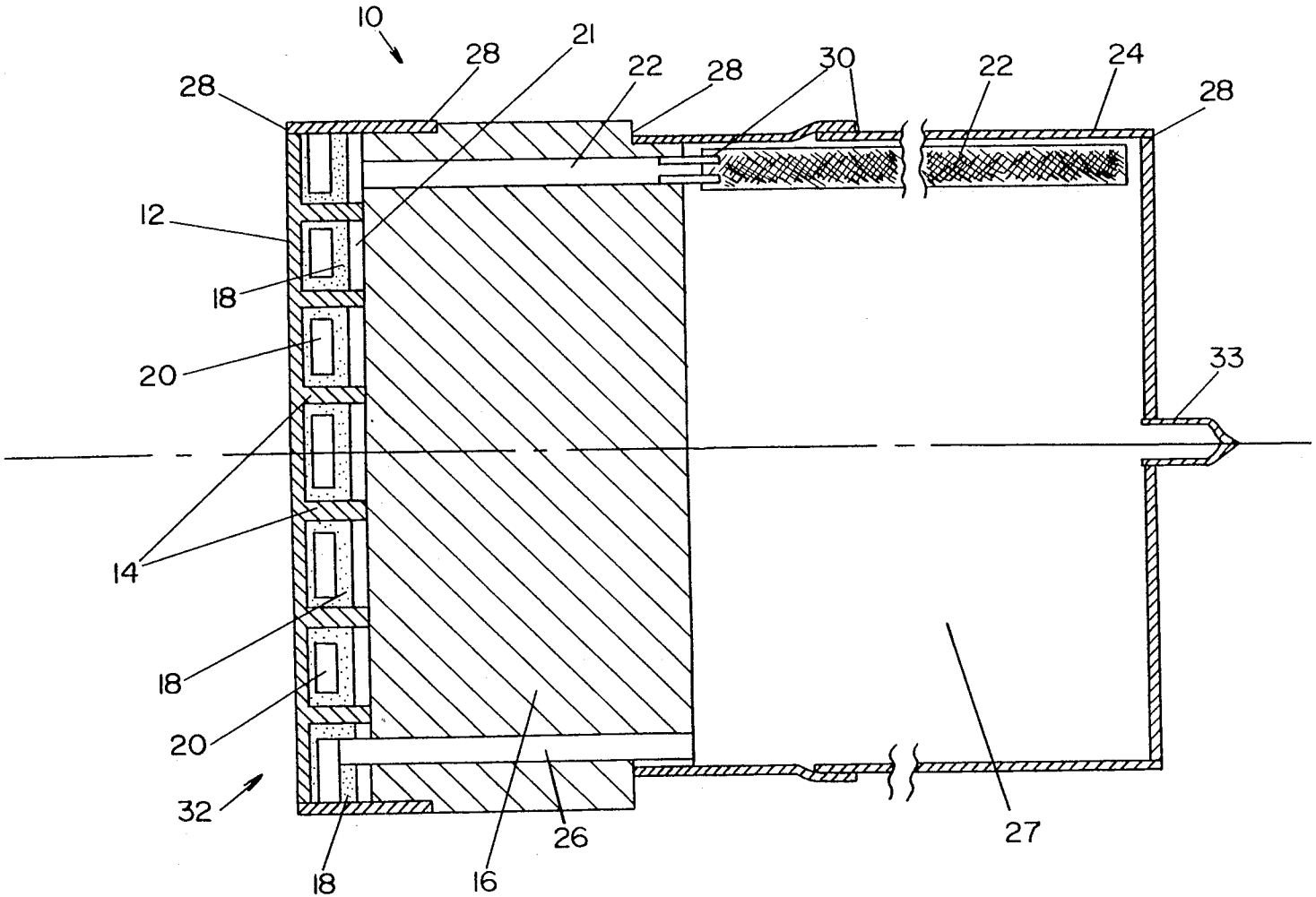
FIG. 1 is an axial cross-section of the heat pipe of the present invention.

FIG. 1 shows a foreshortened heat pipe 10 of the preferred embodiment of the invention where the heat transfer surface, evaporator 12, is a flat silicon wafer which has an array of supports 14 protruding from its backside, toward the interior of heat pipe 10, to furnish structural support for the flat surface. These supports contact strong back 16 which thereby serves as a base support and structural stabilizer for surface 12.

Sintered wick 18 supplies liquid to evaporator 12 by capillary action. Sintered wick 18 is made from a mixture of silicon and glass, with the glass between 10 and 20 percent of the mixture by weight.

Immediately adjacent to evaporator 12 is located a layer of sintered material and a group of tunnel arteries 20 which are enclosed within sintered wick 18. Arteries 20 provide an exit path for the vapor generated by evaporator 12.

Liquid supply passage 22, in part a screen wick artery, extends from the condenser region 24 of heat pipe 10, through strong back 16, and opens into liquid manifold 21 to feed liquid from condenser region 24 to wick 18 through strong back 16.

Vapor passage 26 also extends through strong back 16 and is open to arteries 20, and at its other end opens into vapor space It allows vapor to move from evaporator 12 where it is generated to condenser region 24 where it is condensed.

Except for the assembly with evaporator 12, heat pipe 10 is assembled by conventional techniques, such as brazing or frit sealing at locations 28 and welding or brazing at locations 30. Seal-off tubing 33 is used to remove non-condensible gases from heat pipe 10 and place the required amount of working fluid into it.

Figure 2:
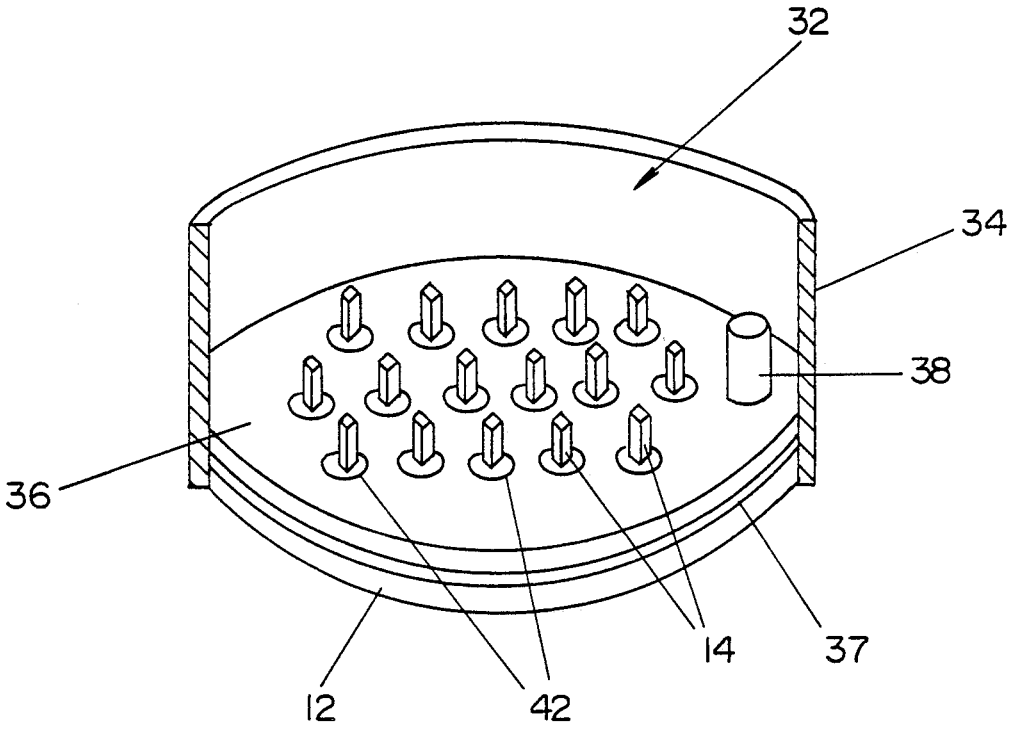
FIG. 2 is a cut-away perspective view of the sintered wick assembly of the invention before the top layer of sintering material is added.

FIG. 2 shows the arrangement of parts during the construction of the preferred embodiment evaporator end assembly 32. To better view the internal parts, retainer 34, which in the preferred embodiment is graphite, is partially cut away. It should also be understood that FIG. 2 pictures the assembly before the addition of most of the sintering powder, which would be added in the next step of the method of the invention.

As pictured, evaporator end assembly includes only evaporator 12 with supports 14 protruding from it, retainer ring 34, graphite core 36, sintering powder layer 37 and artery core 38. To assemble the parts to this point, predrilled core 36, which for the preferred embodiment is also graphite and is in the shape of a circular wafer, is placed over protruding supports 14 and onto thin layer 37 of sintering powder which has been laid on the surface of evaporator 12 and liquid passage core 38 is located on top of core 36. The entire assembly is put together within retainer 34, which, with evaporator 12, serves as a container, particularly for sintering powder layer 37.

The next step is then to place sintering powder into the pictured in FIG. 2, formed by evaporator 12 and retainer 34, up to within 0.050 inch of the top of pillars 14. The entire assembly is then heated in a nuetral atmosphere to sinter the sintering powder. It should be noted that holes 42 in graphite core 36 are large enough to permit sintering material to fill them, and after the material is sintered, there is a continuous layer over all the sides of supports 14. Also, the absence of sintered material to the very top of pillars 14 forms liquid manifold 21 as seen in FIG. 1.

Once the sintered material has hardened from heat, a step which for the preferred embodiment, which uses the silicon and glass material mixture, takes approximately 15 minutes at 1000 degrees C., retainer 34 and core 38 can be saved and the subsequent step speeded up by permitting the assembly to cool and removing retainer 34 and core 38 from it.

The assembly is then reheated in an oxidizing atmosphere to burn off graphite core 36, the top of which is now completely covered with sintered wick 18. For the preferred embodiment, and with retainer 34 and core 38 removed, this takes approximately one hour in air at 1000 degrees C., but this time will vary with the size, mass, and oxygen concentration.

After cooling, evaporator end assembly contains arteries wherever graphite core 36 previously existed. In the case of the preferred embodiment this artery volume is significantly larger than the sintered material in the same plane, but this is clearly a result of the configuration of graphite core 36 which has relatively small holes 42. For other artery configurations the holes could be large relative to the surface area of the core. Moreover, the core could be made of other materials and have noncircular holes or slots, and arteries 12 need not be straight but could be convoluted or curved.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the layer of sintered material 37 between evaporator 12 and core 36 might be omitted, particularly if holes 42 in core 36 were much larger. Also, the evaporator assembly need not be circular in configuration and additional vapor exit and liquid supply passages could be included.

Also, liquid supply passage 22 might be mechanically pumped rather than capillary pumped, and evaporator 12 need not be a part of a heat pipe, but could be a surface exposed to an atmospheric environment, but which uses evaporation cooling.

Moreover, the surface to which the wick is attached could be either flat or curved, and, as previously indicated, the specific materials of the core and the sintered wick and the method of sintering can be varied. For instance, silicon carbide could be substituted for silicon.

What is claimed as new and desired to be secured by Letters Patent of the United States is:

1. An evaporator surface for transferring high power density heat comprising:

a planar sintered wick attached to the evaporator surface on the side opposite from heat entry and including an array of tunnels approximately parallel to the evaporator surface;

liquid access means with one end open to the sintered wick and another end located in proximity to a source of liquid; and vapor access means with one end open to the array of tunnels and another end open to a vapor exit space.

2. The evaporator surface of claim 1 wherein the evaporator surface includes an array of supports protruding from the evaporator surface and into the planar sintered wick.

3. The evaporator surface of claim 2 wherein the supports in the array of supports are coated with the sintered material of the sintered wick.

4. The evaporator surface of claim 1 wherein the liquid access means includes a capillary configuration.

5. The evaporator surface of claim 1 wherein both the liquid access means and the vapor access means are openings from the sintered wick in the surface opposite the side attached to the evaporator surface.

6. The evaporator surface of claim 1 wherein the array of tunnels within the sintered wick is a network of intersecting tunnels.

7. The evaporator surface of claim 1 wherein the evaporator surface is silicon.

8. The evaporator surface of claim 1 wherein the sintered wick is a mixture of silicon and glass with the quantity of glass in the mixture between 10 and 20 percent by weight.

9. The evaporator surface of claim 8 wherein the glass used has a coefficient of thermal expansion approximately the same as silicon.

10. The evaporator surface of claim 2 further including a supporting strong back structure against which the pillars abut to aid in maintaining the evaporator surface as a flat surface.

11. The evaporator surface of claim 2 including a supporting strong back structure to which the supports are bonded.

12. A heat pipe for transferring high power density heat comprising:

a closed, evacuated casing with an evaporator to which heat is applied and a condenser surface from which heat is removed;

a planar sintered wick attached to the evaporator on the inside of the heat pipe and including an array of tunnels approximately parallel to the evaporator;

liquid access means with one end open to the sintered wick and another end located in proximity to the condenser surface;

vapor access means with one end open to the tunnels and another end open to the vapor space of the heat pipe; and a vaporizable liquid within the casing.

13. The heat pipe of claim 12 wherein the evaporator is flat and the heat pipe further includes an array of supports protruding from the back of the evaporator and into the planar sintered wick.

14. The heat pipe of claim 12 further including a supporting strong back structure against which the supports abut, to aid in maintaining the evaporator as a flat surface.

15. The heat pipe of claim 12 wherein the supports in the array of supports are coated with the sintered material of the sintered wick.

16. The heat pipe of claim 12 wherein the liquid access means includes a capillary configuration.

17. The heat pipe of claim 12 wherein both the liquid access means and the vapor access means are openings from the sintered wick in the surface opposite the side attached to the evaporator surface.

18. The heat pipe of claim 12 wherein the array of tunnels within the sintered wick is a network of intersecting tunnels.

19. The heat pipe of claim 12 wherein the first surface is silicon.

20. The heat pipe of claim 12 wherein the sintered wick is a mixture of silicon and glass with the quantity of glass in the mixture between 5 and 30 percent by volume.

21. The heat pipe of claim 20 wherein the glass used has a coefficient of thermal expansion approximately the same as silicon

22. A method of constructing an evaporator assembly with a sintered wick which includes tunnel arteries within it, attached to one surface of the evaporator comprising:

forming the evaporator;

forming a core in the shape of the tunnel arteries;

placing the core on one surface of the evaporator;

covering the core and exposed surface of the evaporator with sintering material;

sintering the sintering material into a wick structure; and heating the assembly of the evaporator, the core and the sintered wick in an oxidizing atmosphere to a temperature and for a time sufficient to burn away the core.

23. The method of claim 22 further including coating a layer of sintering material on the evaporator before placing the core upon it.

24. The method of claim 22 further including using a retainer part to contain the sintering material before sintering and removing the retainer before heating.

25. The method of claim 22 wherein the sintering step comprises heating the evaporator, core and sintering material at a temperature and time sufficient to sinter the sintering material into a wick structure.

26. A sintered structure comprising a mixture of heat conductive sintering material and glass wherein the proportion of glass is 5 to 30 percent by volume and wherein the glass is selected so that its coefficient of thermal expansion is approximately the same as that of the heat conductive sintering material.

* * * * *